US006821235B1

(12) United States Patent
Johnson et al.

(10) Patent No.: US 6,821,235 B1
(45) Date of Patent: Nov. 23, 2004

(54) ANKLE EXERCISE DEVICE

(76) Inventors: John Johnson, 216 E. Oak St., Apt. A, Carbondale, IL (US) 62901; April A. Johnson, 216 E. Oak St., Apt. A, Carbondale, IL (US) 62901

( * ) Notice: Subject to any disclaimer, the term of this patent is extended or adjusted under 35 U.S.C. 154(b) by 0 days.

(21) Appl. No.: 10/280,958

(22) Filed: Oct. 28, 2002

(51) Int. Cl.[7] ..... A63B 23/04

(52) U.S. Cl. ..... 482/79; 482/80; 482/146; 482/147

(58) Field of Search ..... 482/79, 80, 121, 482/907, 51, 52, 72, 127, 145–147

(56) References Cited

U.S. PATENT DOCUMENTS 1,509,793 A * 9/1924 Thompson
2,206,902 A * 7/1940 Kost
3,421,760 A * 1/1969 Freeman
3,782,721 A * 1/1974 Passera
3,802,700 A * 4/1974 Mago
3,984,100 A 10/1976 Firster
4,653,748 A 3/1987 Seel et al.
4,739,986 A 4/1988 Kucharik et al.
4,759,542 A 7/1988 Hudec
5,368,535 A 11/1994 Twardokens
5,368,536 A 11/1994 Stodgell
5,584,787 A 12/1996 Guidry

* cited by examiner

*Primary Examiner*—Jerome W. Donnelly
(74) *Attorney, Agent, or Firm*—Donald R. Schoonover

(57) ABSTRACT

A device includes a foot-engaging element that can move in a spherical pattern and has resistance to movement generated by elastic straps. The straps can be added, changed or removed to customize the resistance to the exact pattern required to achieve maximum benefit for the user. The device does not require a user to place his or her weight on their foot to exercise, strengthen or rehabilitate an ankle. The device can be easily assembled and disassembled and transported.

1 Claim, 4 Drawing Sheets

ANKLE EXERCISE DEVICE

BACKGROUND OF THE INVENTION

1. Field of the Invention

The present invention relates to the general art of fitness, and to the particular field of fitness and rehabilitation.

2. Discussion of the Related Art

As the population becomes more and more active, injuries to various parts of the body are increasing. Strained muscles, ligaments and the like are becoming commonplace. Certainly, such injuries occur in professional sports. One common injury occurs to the ankle joint. This injury can be to the bone, to the muscles, to the tendons or to the ligaments associated with an ankle. These injuries can vary from slight to extremely complex and debilitating.

Often ankle injuries require some rehabilitation and re-strengthening of the ankle and the body parts associated therewith. This may require work with a trainer or in a rehabilitation center.

While the art does contain examples of several devices that can be used to strengthen or rehabilitate an ankle, these devices have several disadvantages. These disadvantages will be understood from the following discussion.

If the rehabilitation/strengthening process requires the participation of another person, be it a trainer, a physical therapist, another health care worker, or simply a partner, the need for a second person may restrict the ability of a person to fully rehabilitate and/or strengthen an ankle. The person is restricted by the schedule of the other person, or by the schedule of the equipment or the like. Often, such rehabilitation is painful and arduous, and any impediment to such rehabilitation and or strengthening should be removed if possible.

Still further, many of the known devices require a person to place his or her weight on the device. This may require the person to place their weight on the injured ankle. Placing the person's weight on the ankle may limit the movement of the ankle during the rehabilitation process and may even re-injure the ankle. In either case, the process of rehabilitation and/or strengthening may be impeded or delayed.

Still further, some parts of an ankle may require movement or resistance that differs from other parts of the ankle. Thus, to be most efficient, each part of the ankle should be exercised in the manner best suited for that part of the ankle and each part should not be limited to the exercise of the overall ankle. However, many presently-available devices are not capable of such precise and customized exercise for an ankle. Still further, some exercise regimens may require movements that differ from movements of other portions of the same exercise routine, or may require a foot to be moved in various manners for the same overall exercise. However, many presently-available devices are not capable of such customized movements.

Still farther, many presently-available devices are cumbersome to use, cumbersome or complicated to assemble and difficult to disassemble. Many of these devices are also large and unsightly. Thus, such devices are not amenable for home use and thus may require a person to travel to a center, which may limit the ability of a person to have access to the machine when he or she wants to work out. Some people may be sized larger or smaller than normal, and these people may find many of the presently-available exercise devices difficult or uncomfortable to use.

PRINCIPAL OBJECTS OF THE INVENTION

It is a main object of the present invention to provide an ankle exercise device.

It is another object of the present invention to provide an ankle exercise device that is versatile.

It is another object of the present invention to provide an ankle exercise device that can accommodate users of various sizes.

It is another object of the present invention to provide an ankle exercise device wherein the amount of resistance can be customized to a particular routine.

It is another object of the present invention to provide an ankle exercise device that can be customized to exercise particular muscles, tendons or ligaments.

It is another object of the present invention to provide an ankle exercise device that can accommodate a wide range of ankle motion.

It is another object of the present invention to provide an ankle exercise device that can accommodate a spherical motion of the foot.

It is another object of the present invention to provide an ankle exercise device that does not require someone to assist a user.

It is another object of the present invention to provide an ankle exercise device that does not require the user to place his or her weight on the injured ankle during a workout.

It is another object of the present invention to provide an ankle exercise device that is portable.

It is another object of the present invention to provide an ankle exercise device that is easily assembled and disassembled and can be easily and conveniently stored between uses.

SUMMARY OF THE INVENTION

These, and other, objects are achieved by an ankle exercise device which includes a base/container unit having a plurality of eye fastener elements mounted thereon; a pedestal unit mounted in the base/container unit; a foot supporting unit movably mounted on the pedestal unit and including a plurality of eye fastener elements mounted on the foot supporting unit; a first plurality of eye fastener elements on the base/container unit; a second plurality of eye fastener elements on the foot supporting unit; and a plurality of elastic resilient tension straps each including a first end having a first eye fastener element-engaging hook thereon which releasably engages an eye fastener element of the first plurality of eye fastener elements in the in-use condition, and a second end having a second eye fastener element-engaging hook thereon which releasably engages an eye fastener element of the second plurality of eye fastener elements in the in-use condition.

The ankle exercise device can be customized by adding, changing or subtracting elastic straps and can rotate in 360° in a plurality of planes. Thus, the device can work any and all muscles, tendons and ligaments of an ankle and does not require a user to place his or her weight on the device. Maximum benefit can thus be obtained from the device. The device is easy to assemble and disassemble and does not require a person to use the assistance of anyone else. Thus, the device can be used at the convenience of the user. The size of the device can adjusted so any user can have maximum comfort and the device is portable.

BRIEF DESCRIPTION OF THE DRAWING FIGURES

DETAILED DESCRIPTION OF THE PREFERRED EMBODIMENT

Figure 1:
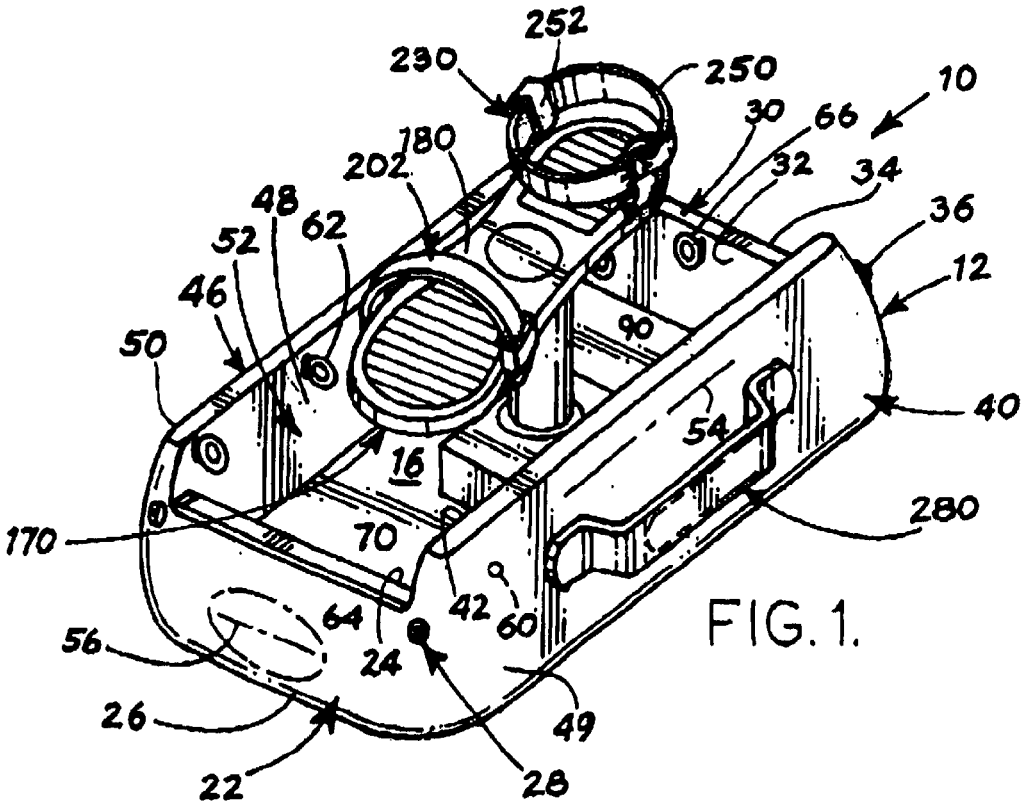
FIG. 1 is a perspective view of an ankle exercise device embodying the present invention.
Figure 4A:
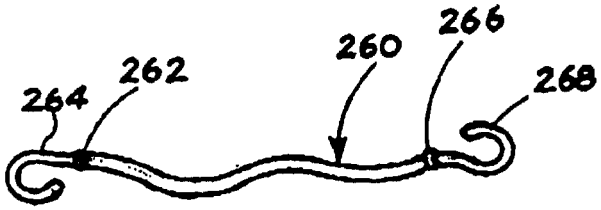
FIG. 4A is an elevational view of an elastic, resilient tension strap of the device embodying the present invention.
Figure 4B:
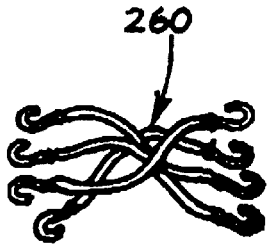
FIG. 4B shows a plurality of the tension straps.
Figure 2:
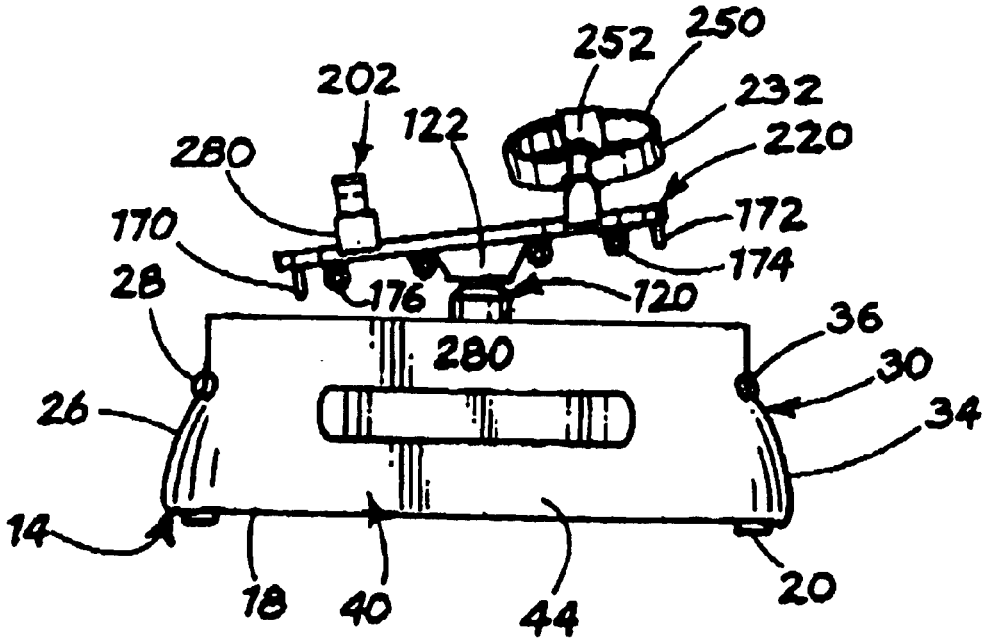
FIG. 2 is a side elevational view of the device embodying the present invention.

Other objects, features and advantages of the invention will become apparent from a consideration of the following detailed description and the accompanying drawings.

Referring to the figures, it can be understood that the present invention is embodied in an ankle exercise device 10 that comprises a base/container unit 12 which includes a bottom 14 having an inner surface 16, an outer surface 18 and feet 20 on the outer surface 18 of the bottom 14. A first end 22 has an inner surface 24 located adjacent to the inner surface 16 of the bottom 14, an outer surface 26 and snap fastener elements, such as snap fastener element 28, on the outer surface 26 of the first end 22. A second end 30 has an inner surface 32 located adjacent to the inner surface 16 of the bottom 14, and an outer surface 34 and snap fastener elements, such as snap fastener element 36, on the outer surface 34 of the second end 30.

A first side 40 has an inner surface 42 located adjacent to the inner surface 16 of the bottom 14 and an outer surface 44. A second side 46 has an inner surface 48 located adjacent to the inner surface 16 of the bottom 14 and an outer surface 50.

The first end 22 and the second end 30 and the first side 40 and the second side 46 extends upwardly from the bottom 14 to define an interior volume 52 in the in-use condition. A longitudinal axis 54 of the base/container unit 12 extends between first end 22 of the base/container unit 12 to second end 30 of the base/container unit 12. A transverse axis 56 extends between first side 40 of the base/container unit 12 to second side 46 of the base/container unit 12.

A first portion of a first plurality of eye fastener elements, such as eye fastener element 60, are mounted on the inner surface 42 of the first side 40. The eye fastener elements 60 of the first plurality of eye fastener elements are spaced apart from each other in the direction of the longitudinal axis 54 of the base/container unit 12. A second portion of the first plurality of eye fastener elements, such as eye fastener element 62, are mounted on the inner surface 48 of the second side 46 and are spaced apart from each other in the direction of the longitudinal axis 54 of the base/container unit 12. A third portion of the first plurality of eye fastener elements, such as eye fastener element 64, are mounted on the inner surface 24 of the first end 22 and are spaced apart from each other in the direction of the transverse axis 56 of the base/container unit 12. A fourth portion of the first plurality of eye fastener elements, such as eye fastener element 66, are mounted on the inner surface 32 of the second end 30 and are spaced apart from each other in the direction of the transverse axis 56 of the base/container unit 12.

Figure 5:
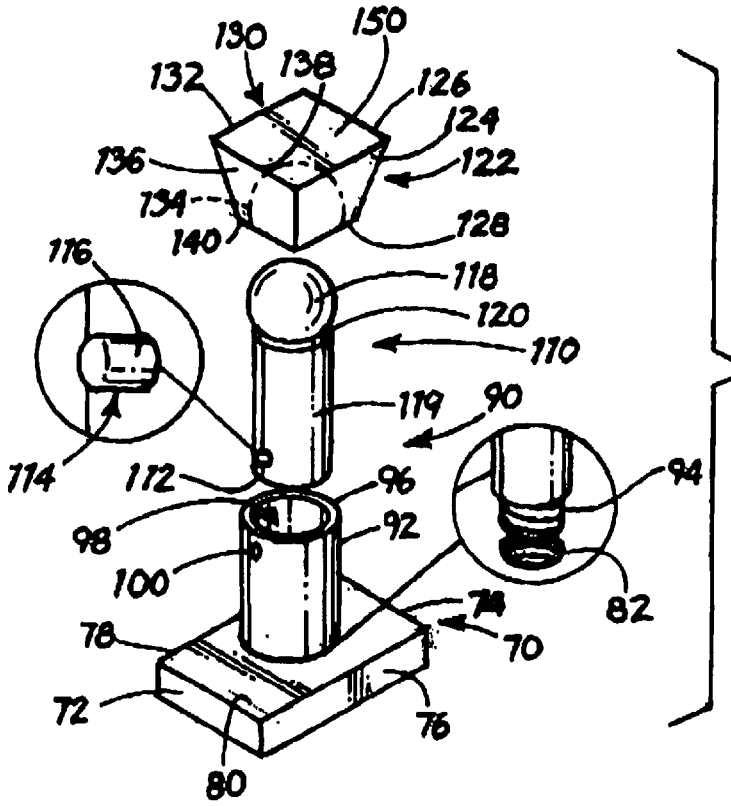
FIG. 5 is an exploded perspective view of a pedestal unit of the device embodying the present invention.

A pedestal mounting base 70 is mounted on the inner surface 16 of the bottom 14 of the base/container unit 12 and is best shown in FIG. 5. Base 70 includes a first end 72 which is spaced apart from the first end 22 of the base/container unit 12 and extends upwardly from the inner surface 16 of the bottom 14 of the base/container unit 12 in the in-use condition, a second end 74 spaced apart from the second end 30 of the base/container unit 12 and extending upwardly from the inner surface 16 of the bottom 14 of the base/container unit 12 in the in-use condition, a first side 76 spaced apart from the first side 40 of the base/container unit 12 and which extends upwardly from the inner surface 16 of the bottom 14 of the base/container unit 12 in the in-use condition, and a second side 78 spaced apart from the second side 46 of the base/container unit 12 and which extends upwardly from the inner surface 16 of the bottom 14 of the base/container unit 12 in the in-use condition. A top 80 is spaced apart from the inner surface 16 of the bottom 14 of the base/container unit 12 in the set-up condition, and an internally threaded bore 82 is defined in the top 80 of the pedestal mounting base 70.

A pedestal unit 90 is also shown in FIG. 5 and includes a first tubular section 92 having an externally threaded proximal end 94 which is threadably received in the internally threaded bore 82 defined in the top 80 of the pedestal mounting base 70 in the in-use condition and a distal end 96. A bore 98 extends between the proximal end 94 of the first tubular section 92 and the distal end 96 of the first tubular section 92. A locking hole 100 is defined through the first tubular section 92 adjacent to the distal end 96 of the first tubular section 92. A second tubular section 110 has a proximal end 112 slidably received in the first tubular section 92 at the distal end 96 of the first tubular section 92 in the in-use condition and a spring-biased locking projection 114 having a spring 116 therein on the second tubular section 110 near the proximal end 112 of the second tubular section 110. The spring-biased locking projection 114 is sized and located to be accommodated in the locking hole 100 defined through the first tubular section 92 in the in-use condition. A mounting ball 118 is mounted on a distal end 119 of the second tubular section 110. A groove 120 is defined in the second tubular section 110 adjacent to the mounting ball 118. A mounting element 122 is movably mounted on the mounting ball 118. The mounting element 122 includes a first planar side surface 124 having a top edge 126 and a bottom edge 128 in the in-use condition, a second planar side surface 130 having a top edge 132 and a bottom edge 134 in the in-use condition, a third planar side surface 136 having a top edge 138 and a bottom edge 140 in the in-use condition, and a fourth planar side surface 142 having a top edge 144 and a bottom edge 146 in the in-use condition. A planar top surface 150 is on the top edges 126, 132, 138, 144 of the planar side surfaces 124, 130, 136, 142, and a chamber 152 is defined between the planar side surfaces 124, 130, 136, 142, and the mounting ball 118 is movably accommodated in the chamber 152 in the in-use condition.

The bottom edges 128, 134, 140, 146 of the side surfaces 124, 130, 136, 142 of the mounting element 122 are accommodated in the groove 120 defined in the second tubular section 110 of the pedestal unit 90 in the in-use condition.

Figure 7:
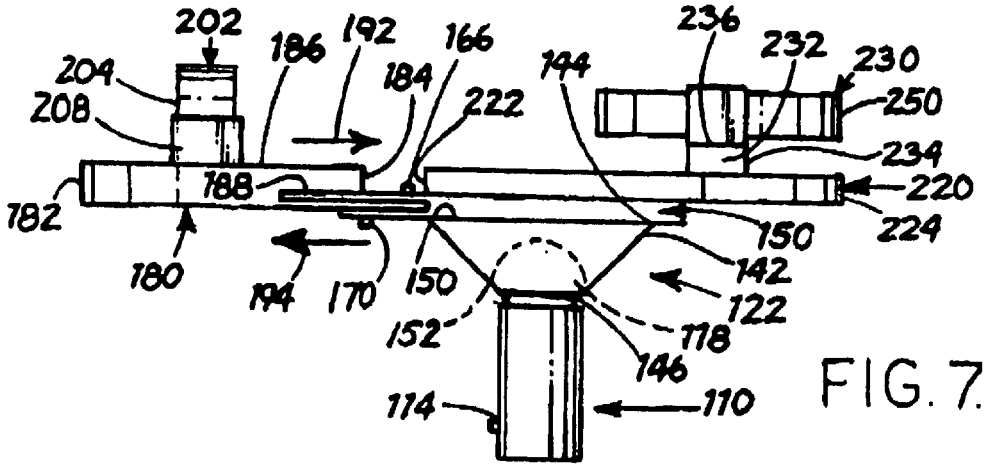
FIG. 7 is an elevational view of the foot-engaging unit mounted on a pedestal of the device of the present invention.
Figure 6:
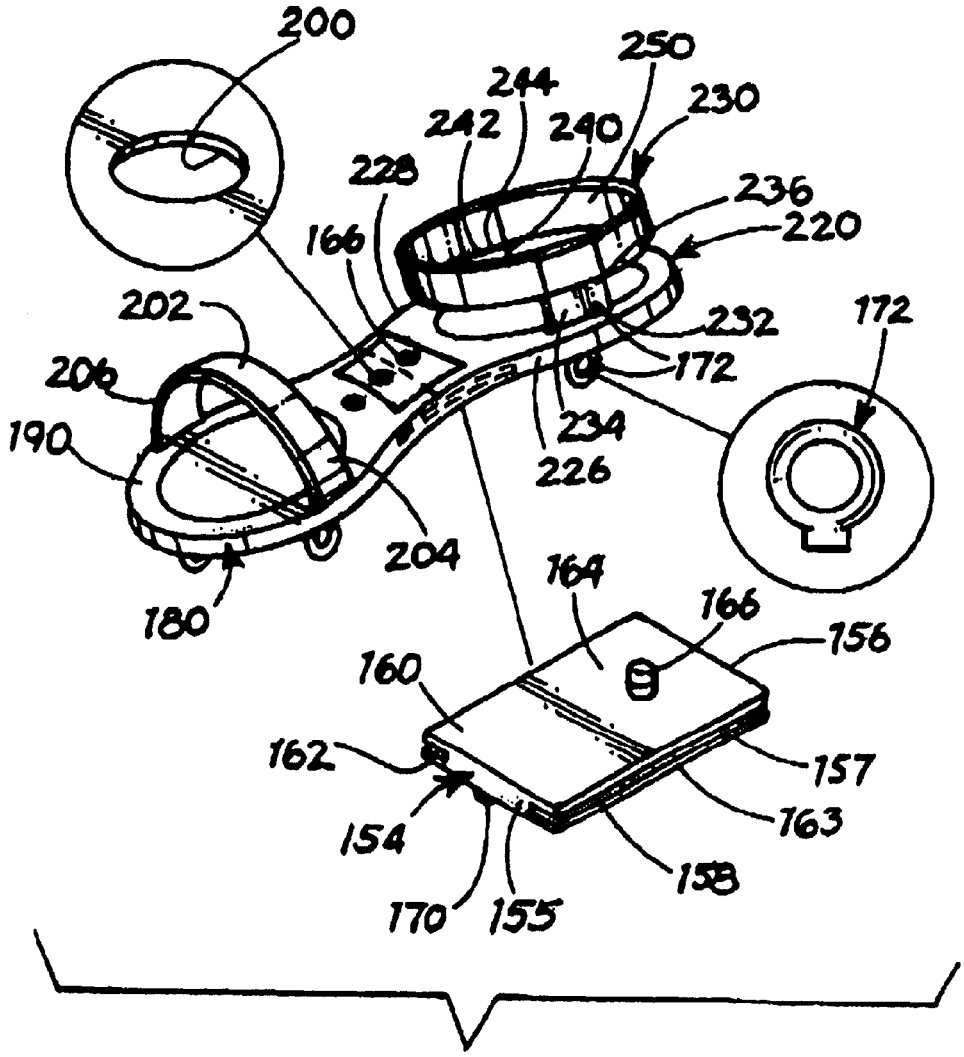
FIG. 6 is an exploded perspective view of a foot-engaging unit of the device embodying the present invention.

A first base plate 154 is shown in FIGS. 6 and 7 and is mounted on the planar top surface 150 of the mounting element 122. The first base plate 154 includes a first end 155, a second end 156, a first side 157 having a groove 158 defined therein from the first end 155 of the first base plate 154 toward the second end 156 of the first base plate 154, a second side 160 having a groove 162 defined therein from the first end 155 of the first base plate 154 toward the second end 156 of the first base plate 154. The first base plate 154 further includes a bottom surface 163 fixed to the planar top surface of the mounting element and a top surface 164. A plurality of locking buttons, such as locking button 166, are located on the top surface 164 of the first base plate 154.

A second plurality of eye fastener elements, such as eye fastener element 170, are mounted on the bottom surface 163 of the first base plate 154. As shown in the figures, the second plurality of eye fastener elements include eye fastener elements, such as eye fastener element 170, located near the first end 155 of the first base plate 154, eye fastener elements, such as eye fastener element 172, located near the second end 156 of the first base plate 154, eye fastener elements, such as eye fastener element 174, located near the first side 157 of the first base plate 154 and eye fastener elements, such as eye fastener element 176, located near the second side 160 of the first base plate 154.

A toe base plate 180 is slidably mounted on the top surface 164 of the first base plate 154 and includes a first end 182, a second end 184, a first side 186 having a tongue 188 thereon which extends from the second end 184 of the toe base plate 180 toward the first end 182 of the toe base plate 180 and which slidably engages the groove 162 defined in the first side 157 of the first base plate 154 in the in-use condition. The toe base plate 180 further includes a second side 190 which is identical to the first side 186 and which is not shown but includes a tongue, identical to tongue 188 thereon and which extends from the second end 184 of the toe base plate 180 toward the first end 182 of the toe base plate 180 and which slidably engages the groove defined in the second side of the first base plate 154 in the in-use condition. The toe base plate 180 thus moves in directions 192 and 194 to adjust the size of the device 10 to the user.

A locking hole 200 is defined in the toe base plate 180 adjacent to the second end 184 of the toe base plate 180 and accommodates one locking button of the plurality of locking buttons on the top surface 164 of the first base plate 154 in the in-use condition. A foot accommodating strap 202 has a first end 204 fixed to the first side 186 of the toe base plate 180 and a second end 206 fixed to the second side 190 of the toe base plate 180. A size adjusting element 208 is located on the foot accommodating strap 202 so users having various size feet can be accommodated by the device 10.

A heel base plate 220 is mounted on the top surface 164 of the first base plate 154. Heel base plate 220 includes a first end 222 located adjacent to the second end 184 of the toe base plate 180 in the in-use condition, a second end 224, a first side 226 and a second side 228.

A leg accommodating strap unit 230 is mounted on the heel base plate 220 and includes a first strap 232 having a proximal end 234 fixed to the first side 226 of the heel base plate 220 near the second end 224 of the heel base plate 220 and a distal end 236. A second strap 240 has a proximal end 242 fixed to the second side 228 of the heel base plate 220 near the second end 224 of the heel base plate 220 and a distal end 244. A leg-encircling strap 250 is attached to the distal ends 236, 244 of the first and second straps 232, 240 of the leg accommodating strap unit 230. A size-adjusting element 252 is attached to the leg-encircling strap 250 so users having various leg sizes can be accommodated by the device 10.

A plurality of elastic, resilient straps, such as elastic, resilient strap 260 are identical to each other and each includes a first end 262 having a first eye fastener element-engaging hook 264 thereon which releasably engages an eye fastener element of the first plurality of eye fastener elements 60 in the in-use condition and a second end 266 having a second eye fastener element-engaging hook 268 thereon which releasably engages an eye fastener element of the second plurality of eye fastener elements 170 in the in-use condition. The straps 260 establish resistance to movement of the toe base plate 180 and to movement of the heel base plate 220. The straps 260 can have varying tensions whereby different movements of the same overall exercise will have different resistances. Furthermore, the straps 260 can have different tensions whereby a user can increase resistance to movement as the workout progresses. This permits a user to customize a particular exercise and to alter exercise routines as progress is made. As can be understood from this disclosure, the heel base plate 220 and the toe base plate 180 are able to move in a spherical movement so the user can move his or her foot in an infinite number of planes. This further facilitates the exercise routines. Still further, due to the tension straps 260, the user need not place any of his or her weight on the foot or ankle during the exercise routine.

Figure 3:
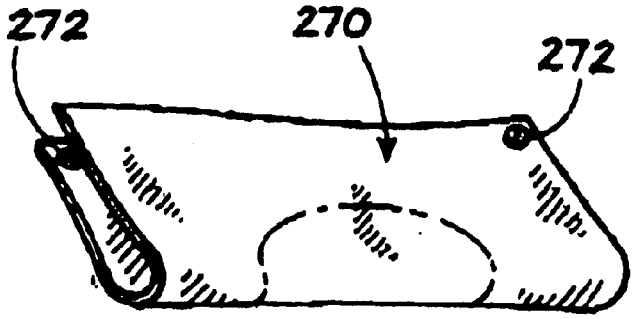
FIG. 3 is a perspective view of a cover for the device embodying the present invention.

A cover unit 270 is shown in FIG. 3 and includes a plurality of snap fastener engaging elements, such as snap fastener-engaging element 272 thereon, which releasably engage the snap fastener elements 28, 36 on the outer surfaces 26, 34 of the first and second ends 22, 30 of the base/container unit 12 in the in-use condition of the cover unit 270.

A handle 280 is mounted on first side 40 of the base/container unit 12 and is used to carry the device 10.

It is understood that while certain forms of the present invention have been illustrated and described herein, it is not to be limited to the specific forms or arrangements of parts described and shown.

What is claimed and desired to be covered by Letters Patent is:

1. An ankle exercise device comprising:

a) a base unit which includes (1) a bottom having an inner surface, an outer surface and feet on the outer surface of the bottom, (2) a first end having an inner surface located adjacent to the inner surface of the bottom, an outer surface and snap fastener elements on the outer surface of the first end, (3) a second end having an inner surface located adjacent to the inner surface of the bottom, an outer surface and snap fastener elements on the outer surface of the second end, (4) a first side having an inner surface located adjacent to the inner surface of the bottom, and an outer surface, (5) a second side having an inner surface located adjacent to the inner surface of the bottom, and an outer surface, (6) the first end and the second end and the first side and the second side extending upwardly from the bottom to define an interior volume in the in-use condition, (7) a longitudinal axis of said base unit which extends between the first end of said base unit to the second end of said base unit, (8) a transverse axis of said base unit which extends between the first side of said base unit to the second side of said base unit, (9) a first portion of a first plurality of eye fastener elements mounted on the inner surface of the first side and having eye fastener elements of the first portion of the first plurality of eye fastener elements spaced apart from each other in the direction of the longitudinal axis of said base unit,

(10) a second portion of the first plurality of eye fastener elements mounted on the inner surface of the second side and having eye fastener elements of the second portion of the first plurality of eye fastener elements spaced apart from each other in the direction of the longitudinal axis of said base unit,

(11) a third portion of the first plurality of eye fastener elements mounted on the inner surface of the first end and having eye fastener elements of the third portion of the first plurality of eye fastener elements spaced apart from each other in the direction of the transverse axis of said base unit,

(12) a fourth portion of the first plurality of eye fastener elements mounted on the inner surface of the second end and having eye fastener elements of the fourth portion of the first plurality of eye fastener elements spaced apart from each other in the direction of the transverse axis of said base unit, and

(13) a pedestal mounting base mounted on the inner surface of the bottom of said base unit and which includes a first end spaced apart from the first end of said base unit and which extends upwardly from the inner surface of the bottom of said base unit in the in-use condition, a second end spaced apart from the second end of said base unit and which extends upwardly from the inner surface of the bottom of said base unit in the in-use condition, a first side spaced apart from the first side of said base unit and which extends upwardly from the inner surface of the bottom of said base unit in the in-use condition, a second side spaced apart from the second side of said base unit and which extends upwardly from the inner surface of the bottom of said base unit in the in-use condition, a top spaced apart from the inner surface of the bottom of said base unit in the set-up condition, and an internally threaded bore defined in the top of the pedestal mounting base;

b) a pedestal unit which includes (1) a first tubular section having an externally threaded proximal end which is threadably received in the internally threaded bore defined in the top of the pedestal mounting base in the in-use condition, a distal end, a bore extending between the proximal end of the first tubular section and the distal end of the first tubular section, and a locking hole defined through the first tubular section adjacent to the distal end of the first tubular section, (2) a second tubular section having a proximal end slidably received in the first tubular section at the distal end of the first tubular section in the in-use condition, and a spring-biased locking projection on the second tubular section near the proximal end of the second tubular section, the spring-biased locking projection being sized and located to be accommodated in the locking hole defined through the first tubular section in the in-use condition, (3) a mounting ball on the distal end of the second tubular section, (4) a groove defined in the second tubular section adjacent to the mounting ball, and (5) a mounting element movably mounted on the mounting ball, the mounting element including (A) a first planar side surface having a top edge and a bottom edge in the in-use condition, (B) a second planar side surface having a top edge and a bottom edge in the in-use condition, (C) a third planar side surface having a top edge and a bottom edge in the in-use condition, (D) a fourth planar side surface having a top edge and a bottom edge in the in-use condition, (E) a planar top surface on the top edges of the planar side surfaces, (F) a chamber defined between the planar side surfaces, the mounting ball being accommodated in the chamber in the in-use condition, (6) the bottom edges of the side surfaces of the mounting element being accommodated in the groove defined in the second tubular section of the pedestal unit in the in-use condition;

c) a first base plate mounted on the planar top surface of the mounting element, said first base plate including (1) a first end, (2) a second end, (3) a first side having a groove defined therein from the first end of said first base plate toward the second end of said first base plate, (4) a second side having a groove defined therein from the first end of said first base plate toward the second end of said first base plate, (5) a bottom surface fixed to the planar top surface of the mounting element, (6) a top surface, (7) a plurality of locking buttons on the top surface of said base plate, and (8) a second plurality of eye fastener elements mounted on the bottom surface of said first base plate, the second plurality of eye fastener elements including eye fastener elements located near the first end of said first base plate, eye fastener elements located near the second end of the first base plate, eye fastener elements located near the first side of the first base plate, and eye fastener elements located near the second side of the first base plate;

d) a toe base plate slidably mounted on the top surface of said first base plate and including (1) a first end, (2) a second end, (3) a first side having a tongue thereon which extends from the second end of said toe base plate toward the first end of said toe base plate and which slidably engages the groove defined in the first side of said first base plate in the in-use condition, (4) a second side having a tongue thereon which extends from the second end of said toe base plate toward the first end of said toe base plate and which slidably engages the groove defined in the second side of said first base plate in the in-use condition, (5) a locking hole defined in said toe base plate adjacent to the second end of said toe base plate and which accommodates one locking button of said plurality of locking buttons on the top surface of said first base plate in the in-use condition, and (6) a foot accommodating strap having a first end fixed to the first side of said toe base plate and a second end fixed to the second side of said toe base plate, and a size adjusting element on the foot-accommodating strap;

e) a heel base plate mounted on the top surface of said first base plate and which includes (1) a first end located adjacent to the second end of said toe base plate in the in-use condition, (2) a second end,
(3) a first side,
(4) a second side,
(5) a leg-accommodating strap unit mounted on said heel base plate and including
(A) a first strap having a proximal end fixed to the first side of said heel base plate near the second end of said heel base plate and a distal end,
(B) a second strap having a proximal end fixed to the second side of said heel base plate near the second end of said heel base plate and a distal end,
(C) a leg-encircling strap attached to the distal ends of the first and second straps of the leg accommodating strap unit, and
(D) a size-adjusting element attached to the leg-encircling strap;

f) a plurality of elastic, resilient straps, each elastic, resilient strap including
(1) a first end having a first eye fastener element engaging hook thereon which releasably engages an eye fastener element of the first plurality of eye fastener elements in the in-use condition, and
(2) a second end having a second eye fastener element engaging hook thereon which releasably engages an eye fastener element of the second plurality of eye fastener elements in the in-use condition;

g) a cover unit which includes a plurality of snap fastener engaging elements thereon which releasably engage the snap fastener elements on the outer surfaces of the first and second ends of said base unit in the in-use condition of said cover unit; and h) a handle mounted on the first side of said base unit.

* * * * *